US005640652A

United States Patent [19]

Nagase et al.

[11] Patent Number: 5,640,652

[45] Date of Patent: Jun. 17, 1997

[54] DRIVING MECHANISM FOR COLOR IMAGE FORMING APPARATUS

[75] Inventors: Hisayoshi Nagase; Shuta Hamada; Satoshi Haneda, all of Hachioji, Japan

[73] Assignee: Konica Corporation, Tokyo, Japan

[21] Appl. No.: 589,595

[22] Filed: Jan. 22, 1996

[30] Foreign Application Priority Data

Jan. 25, 1995 [JP] Japan ..... 7-009956

[51] Int. Cl.[6] ..... G03G 15/00; G03G 15/01

[52] U.S. Cl. ..... 399/167; 399/178

[58] Field of Search ..... 355/326 R, 327, 355/211, 200, 210

[56] References Cited

U.S. PATENT DOCUMENTS

| | | | |
|---|---|---|---|
| 5,126,800 | 6/1992 | Shishido et al. | 355/211 |
| 5,452,064 | 9/1995 | Inomata | 355/200 X |
| 5,541,722 | 7/1996 | Ikeda et al. | 355/326 R |

FOREIGN PATENT DOCUMENTS

| | | |
|---|---|---|
| 5-307307 | 11/1993 | Japan . |
| 6-35285 | 2/1994 | Japan . |

*Primary Examiner*—Arthur T. Grimley
*Assistant Examiner*—Sophia Chen
*Attorney, Agent, or Firm*—Frishauf, Holtz, Goodman, Langer & Chick

[57] ABSTRACT

A color image forming apparatus includes a plurality of chargers each provided in a periphery of an image forming body for charging the image forming body; at least two of a plurality of imagewise exposure devices each equally spaced with respect to the image forming body, for imagewise exposing a charged image forming body to form a latent image; and a plurality of developing devices each provided in the periphery of the image forming body to develop the latent image to form a toner image. During one rotation of the image forming body, a sequence of charging, exposing and developing is repeated to superimpose the toner images, and them the toner images are transferred onto a recording medium at one time, wherein a number of teeth, which corresponds to an interval of the plurality of imagewise exposure means, of a follower gear provided on the image forming body is the same as a number of teeth of a drive gear provided on a main body of the apparatus, or is an integer multiple of the number of teeth of the drive gear.

6 Claims, 7 Drawing Sheets

DRIVING MECHANISM FOR COLOR IMAGE FORMING APPARATUS

BACKGROUND OF THE INVENTION

The present invention relates to an electrophotographic color image forming apparatus in which a plurality of charging means, image-wise exposure means and developing means are arranged around a drum-like or a belt-like image forming body, and in which a color image is formed by superimposing toner images on the image forming body during a single rotation of the image forming body.

The following are widely known as multi-color image forming apparatuses. (A): a color image forming apparatus which is provided with the same number of photoreceptors, chargers and developing units as the number of required colors, and in which mono-color toner images respectively formed on the respective photoreceptors, are superimposed on an intermediate transfer body. (B): a color image forming apparatus in which a photoreceptor is rotated plural times, and charging, image-wise exposure and developing for each color are repeated. (C): a color image forming apparatus in which charging, image-wise exposure and developing for each color are successively conducted during single rotation of the photoreceptor.

However, the above-described apparatus (A) has a disadvantage in which dimensions of the apparatus are excessive because of the plurality of photoreceptors or an intermediate transfer body. On the other hand, dimensions of the apparatus (B) are reduced due to only one charging means, image-wise exposure means and photoreceptor, but sizes of the formed image is limited within the surface area of the photoreceptor.

In contrast to the above-described two apparatus, the apparatus (C) has excellent advantages in which the size of the image is not limited and in addition images are formed at a higher speed.

However, the apparatus (C) has the following disadvantages. When a drive gear for transmitting the drive force to the image forming body has uneven pitch or fluctuations of the depth of engagement, the transmission speed is periodically changed and causes the peripheral speed of the image forming body to fluctuate, even though the motor speed is constant. Therefore, registration of the images to be superimposed is changed, and doubling occurs and image quality is greatly lowered.

SUMMARY OF THE INVENTION

As a result of solution and improvement with respect to the above-described disadvantages, an object of the present invention is to provide a color image forming apparatus in which toner images are accurately superimposed, no doubling occurs and high quality images can be recorded, even when the transmission speed due to the drive gear is periodically changed.

The first embodiment to attain the above-described object is structured as follows. In a color image forming apparatus in which a plurality of charging means for charging, image-wise exposure means for forming a latent image, and developing means for visualizing the latent image, are arranged around the peripheral surface of an image forming body rotated by drive of gears; and after toner images are superimposed by repeating charging, image-wise exposure and developing during one rotation of the image forming body, the toner images are collectively transferred onto a transfer material, the image forming means are arranged around the image forming body, and the number of teeth, which corresponds to the interval of the image-wise exposure means, of a driven gear provided to the image forming body is the same as the number of teeth of a drive gear, or is an integer multiple of the number of teeth of the drive gear.

The second embodiment to attain the above-described object is structured as follows. In a color image forming apparatus in which a plurality of charging means for charging, image-wise exposure means for forming a latent image, and developing means for visualizing the latent image, are arranged around the peripheral surface of an image forming body rotated by drive of gears; and after toner images are superimposed by repeating charging, image-wise exposure and developing during one rotation of the image forming body, the toner images are collectively transferred onto a transfer material, the image-wise exposure means are arranged around the image forming body, and the total number of teeth of a driven gear provided to the image forming body is an integer multiple of the number of teeth of the drive gear.

DETAILED DESCRIPTION OF THE PREFERRED EMBODIMENT

Before the explanation of examples, the structure and functions of a color image forming apparatus according to the present invention will be described below.

Figure 1:
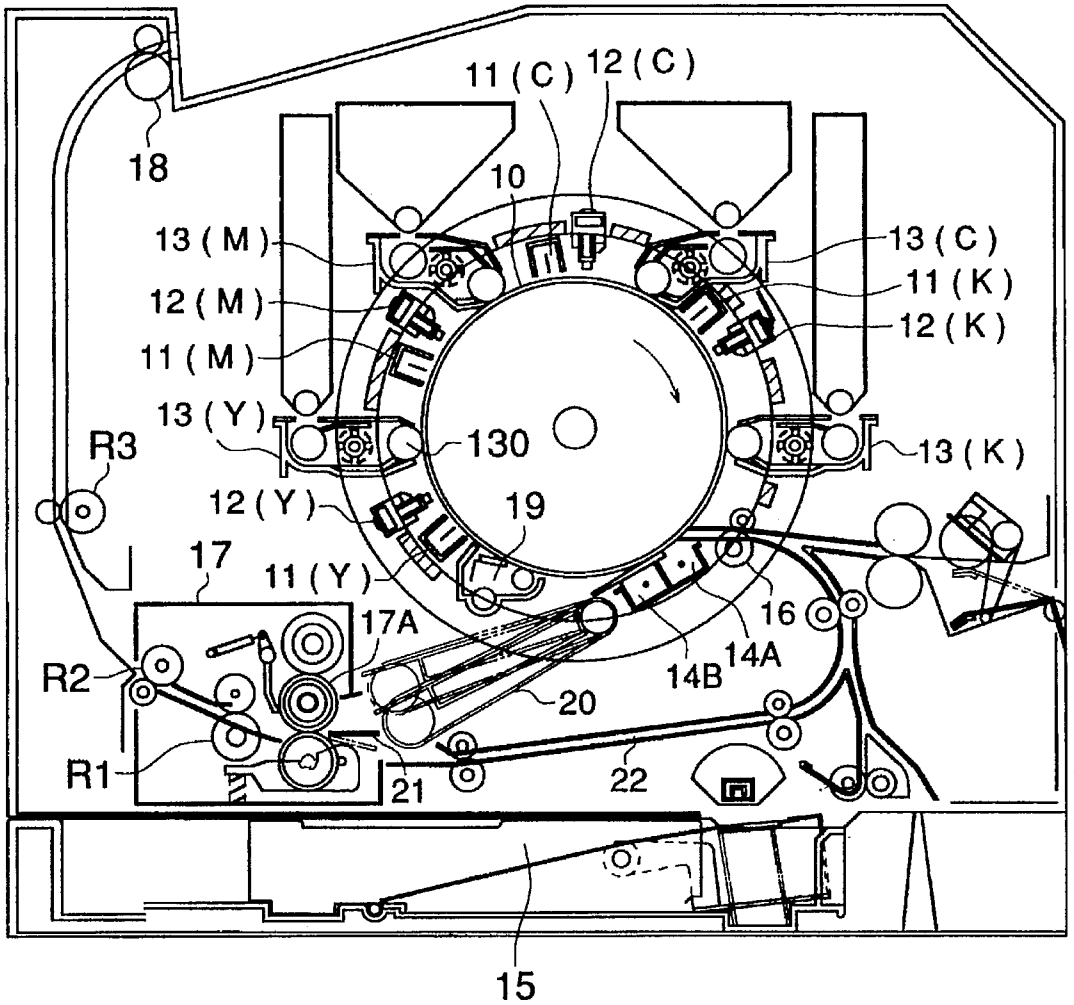
FIG. 1 is a sectional structural view of a color image forming apparatus (1) of the present invention.

FIG. 1 shows a color image forming apparatus in which an image-wise exposure means is arranged opposed to the peripheral surface of an image forming body, and image-wise exposure is conducted on the peripheral surface of the image forming body from the outside of the image forming body.

Numeral 10 is a photoreceptor drum which is an image forming body, an OPC photoreceptor is coated on the drum, and is rotated clockwise while being electrically grounded.

Numeral 11 is a scorotron charger which is a charging means, and by which charging is conducted on the organic photoreceptor layer, by a corona discharge using a grid, which is maintained at a predetermined potential voltage, and a discharge wire, so that a uniform potential voltage is applied on the photoreceptor drum 10.

Numeral 12 is an exposure optical system, which is an image-wise exposure means composed of light emitting elements such as LEDs, FLs, ELs, or PLs, arranged in the direction of an axis of the photoreceptor drum 10, and a SELFOC lens. Each color image signal, which is read by an image reading device, is successively read from a memory, and is inputted into the exposure optical system 12, as an electric signal. A wavelength of the emitted light beam from the light emitting elements, used in this example, is 600–800 nm.

The exposure optical system 12 may be composed of a combination of optical shutter members such as LCD, LISA, PLZT, etc., except the above-described light emitting elements, and an image formation lens such as a SELFOC lens, or the like.

13Y, 13M, 13C and 13K are developing units, which is a developing means, in which yellow (Y), magenta (M), cyan (C) and black (B) developers are respectively accommodated, and each developing unit is provided with a developing sleeve 130 which is rotated in one direction at a predetermined interval with respect to the peripheral surface of the photoreceptor drum 10.

The above-described developing unit 13 contactlessly reversal-develops an electrostatic latent image on the photoreceptor drum 10 formed by charging by the charger 11 and the image-wise exposure by the exposure optical system 12, by an application of the developing bias voltage.

Next, processes of the color image formation in this apparatus, will be described below.

A document image read by the image pick-up element in an image reading device, which is provided separately from this apparatus, or an image edited by a computer, is temporarily stored in a memory as an image signal for each color, Y, M, C and K.

A photoreceptor drive motor is rotated when image recording starts, and the photoreceptor drum 10 is rotated clockwise. Simultaneously, potential voltage application onto the photoreceptor drum 10 starts by charging action of the charger 11(Y).

After the potential voltage has been applied onto the photoreceptor drum 10, the image-wise exposure is started by an electric signal corresponding to an image signal of the first color signal, that is yellow (Y), in the exposure optical system 12(Y). An electrostatic latent image corresponding to a yellow (Y) image in the document image is formed on the photoreceptor layer, provided on the peripheral surface of the photoreceptor drum, by rotational scanning of the photoreceptor drum.

This latent image is reversal-developed contactlessly by the developer on the developing sleeve provided in the developing unit 13(Y), and a yellow (Y) toner image is formed corresponding to the rotation of the photoreceptor drum 10.

Next, a potential voltage is further applied on the yellow (Y) toner image on the photoreceptor drum 10 by charging action of the charger 11 (M). The image-wise exposure is conducted by an electric signal corresponding to an image signal of the second color signal in the exposure optical system 12 (M), i.e., magenta (M). The magenta (M) toner image is formed by being superimposed on the yellow (Y) toner image by contactless reversal development by the developing unit 13(M).

By the same processes as described above, the cyan (C) toner image corresponding to the third color signal is formed by being superimposed on the photoreceptor drum by the charger 11(C), the exposure optical system 12(C) and the developing unit 13 (C). Finally, the black (K) toner image corresponding to the fourth color signal is formed by being superimposed on the photoreceptor drum by the charger 11 (K), exposure optical system 12 (K) and the developing unit 13 (K). Thus, a color toner image is formed on the peripheral surface of the photoreceptor drum 10 during a single rotation of the photoreceptor drum.

The color toner image formed on the peripheral surface of the photoreceptor drum 10, is transferred by a transfer unit 14A onto a transfer sheet which is conveyed from a sheet feed cassette 15, and is fed synchronously with the photoreceptor drum by the drive of a timing roller 16.

The transfer sheet, onto which a toner image is transferred, is discharged by a discharger 14B, separated from the peripheral surface of the photoreceptor drum, and toner is fusion-adhered to the transfer sheet in a fixing device 17 after being conveyed through a conveyance belt 20. After that, the transfer sheet is delivered onto a tray provided in the upper portion of the apparatus through a sheet feed roller 18 in the case of a single-sided copy.

In the case of double-sided copy, the transfer sheet, which has passed through the fixing unit 17, is reversely sent from the fixing unit 17 by the reverse rotation of a fixing roller 17A, conveyance rollers R1, R2 and R3, and is sent to a reversed sheet feeding path 22, simultaneously when the conveyance belt 20 and a fixing guide plate 21 respectively move to the position shown by a two-dotted chain line. The transfer sheet is reversed upside down while it passes through the reversed sheet feeding path 22 and moves again into a sheet feeding path of the sheet feeding cassette 15. The image on the rear surface of the transfer sheet is transferred after passing again through the timing roller 16. The image on the rear surface of the transfer sheet is fixed when the conveyance belt 20 and the fixing guide plate 21 return to the initial position, and the rotation of the fixing roller 17A and conveyance rollers R1 and R2 is switched to normal, and after images have been respectively recorded on the double sides of the transfer sheet, the transfer sheet is delivered.

On the other hand, the remaining toner on the photoreceptor drum 10, from which the transfer sheet has been separated, is removed, and the photoreceptor drum 10 is cleaned, in a cleaning unit 19, and toner image formation of the document image is continued, or the photoreceptor drum stops once and waits for toner image formation of the new document images.

Figure 2:
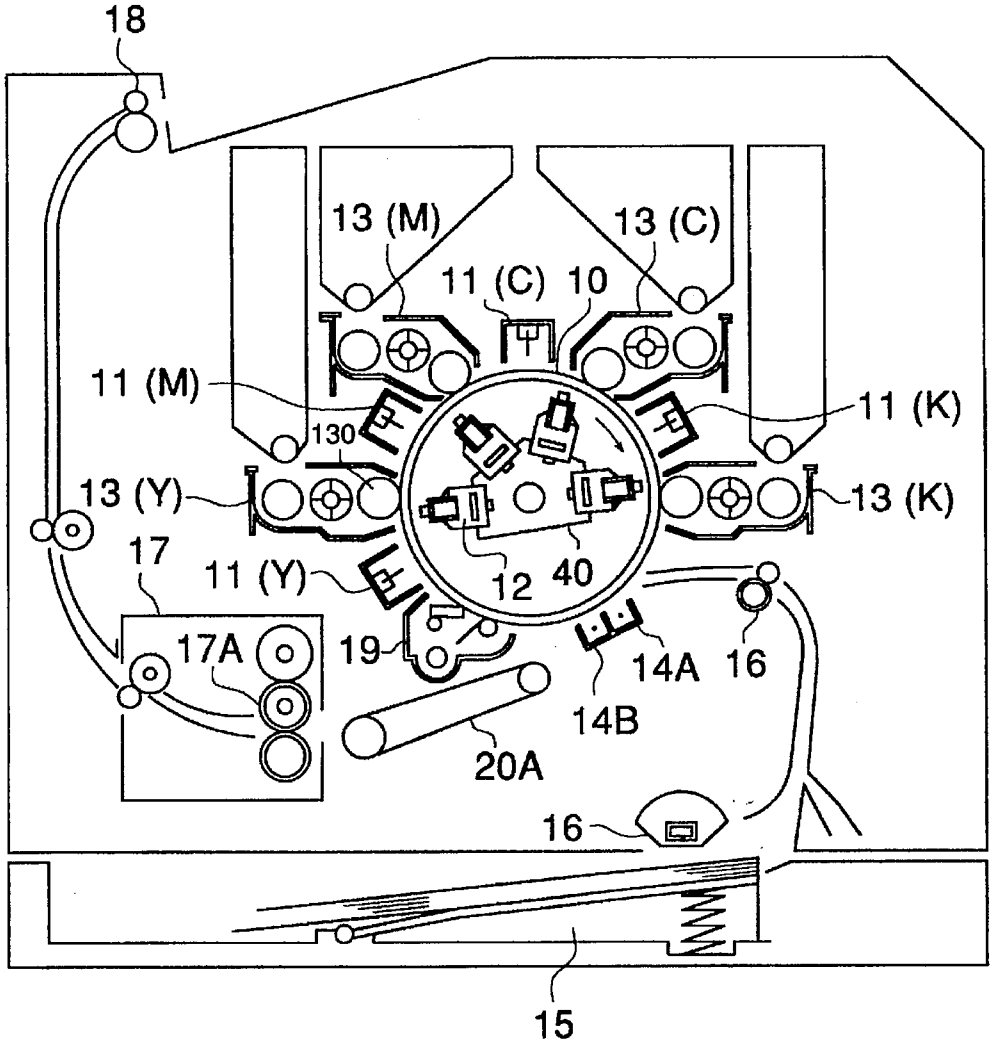
FIG. 2 is a sectional structural view of a color image forming apparatus (2) of the present invention.

FIG. 2 shows a color image forming apparatus in which a base body of the photoreceptor drum 10 is formed by a transparent member, each exposure optical system 12 is arranged opposed to the inner peripheral surface, and the image-wise exposure is conducted through the base body from the inside of the photoreceptor drum 10. In FIG. 2 members having the same function as in FIG. 1 are shown by the same numbers.

The photoreceptor drum 10 used for the apparatus is structured as follows. An organic photoreceptor layer (OPC), formed Of a transparent conductive layer, is coated on the outer periphery of the base body formed by a transparent member such as optical glass, transparent acrylic resin, or the like, and the photoreceptor drum is rotated clockwise under the condition that the transparent conductive layer is electrically grounded. In the above description, "transparent" means that each of the member and layer has transparency with respect to light beams outputted from the exposure optical system.

Numeral 11 is a scorotron charger which is a charging means, and which charges the organic photoreceptor layer on the photoreceptor drum by a corona discharge using a grid with a predetermined potential voltage and the discharge wire, so that a uniform potential voltage is applied on the photoreceptor drum 10.

Numeral 12 is an exposure optical system, which is an image-wise exposure means composed of light emitting elements such as LEDs, FLs, ELs, or PLs, arranged in the direction of an axis of the photoreceptor drum 10, and a SELFOC lens. An each color image signal, which is read by an image reading device, is successively read from a memory and is respectively inputted into the exposure optical system 12, as an electric signal. A wavelength of the emitted light beam from the light emitting elements, used in this example, is 600–800 nm.

The exposure optical system 12 is mounted each on a columnar supporting member 40, and accommodated in the photoreceptor drum 10 base body. The exposure optical system 12 may be composed of a combination of optical shutter members such as LCD, LISA, PLZT, etc., except the above-described light emitting elements, and an image formation lens such as a SELFOC lens, or the like.

Numeral 13 are developing units, which is a developing means, in which yellow (Y), magenta (M), cyan (C) and black (B) developers are respectively accommodated, and each developing unit is provided with a developing sleeve 130 which is rotated in one direction at a predetermined interval with respect to the peripheral surface of the photoreceptor drum 10.

The above-described developing unit 13 contactlessly reversal-develops an electrostatic latent image formed on the photoreceptor drum 10, formed by charging by the charger 11 and the image-wise exposure by the exposure optical system 12, when the developing bias voltage is applied.

The image formation and recording in this apparatus is conducted by the same process as that in the above-described apparatus.

Figure 3:
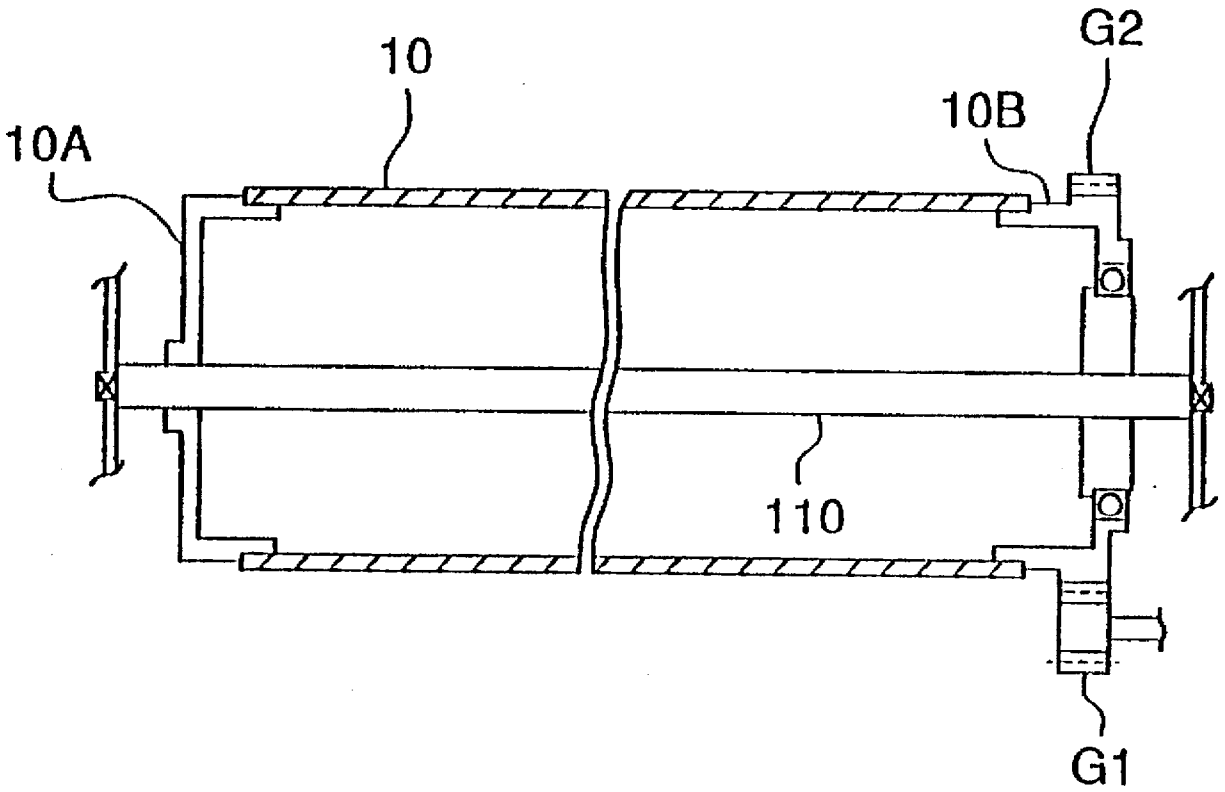
FIG. 3 is a sectional structural view of a photoreceptor drum.

The axial length of the photoreceptor drum 10 of the apparatus shown in FIG. 1, which is a cylindrical member, is larger than the width of the recording sheet to be transferred. As shown in FIG. 3, flange members 10A and 10B are engaged and integrated with both ends of the photoreceptor drum 10, and the photoreceptor drum 10 is rotatably supported on a drum shaft 110 provided between the base plates of the apparatus.

The flange member 10B is integrally formed with a large gear G2 which is engaged with the drive gear G1 provided in the apparatus main body, and is driven in the predetermined direction by the power of the main body side.

In the case of the photoreceptor drum 10 of the apparatus shown in FIG. 2, the flange members 10A and 10B are directly supported by the apparatus base plates, since the exposure optical system 12 is integrated in the photoreceptor drum. The large gear G2 of the flange member 10B is driven by the rotation of the drive gear G1.

Figure 4:
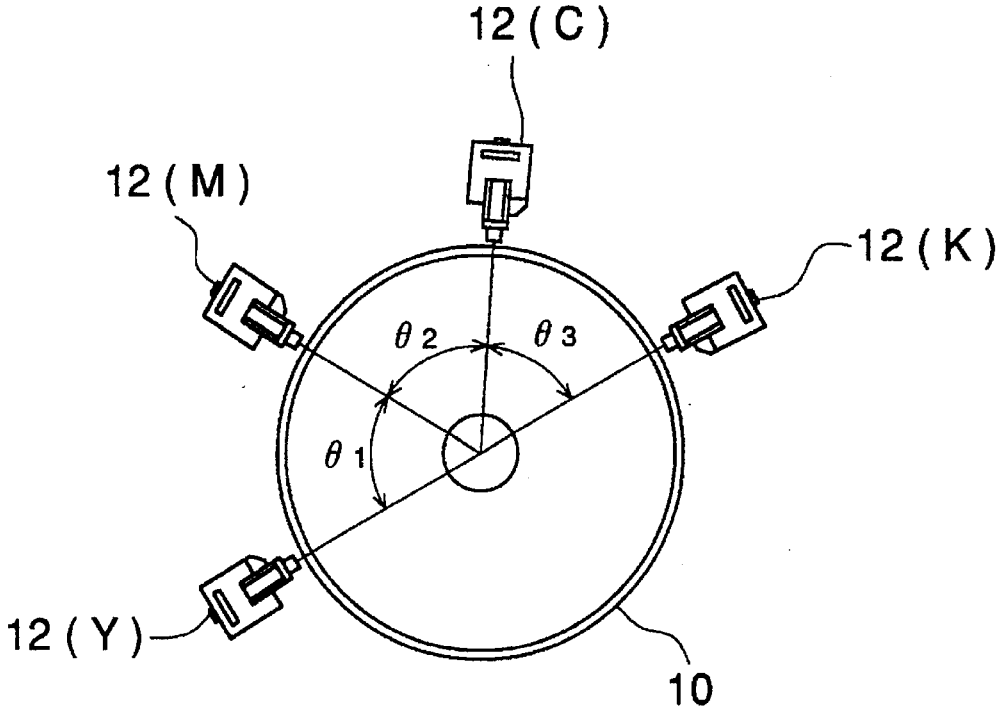
FIG. 4 is a view of the arrangement of an exposure optical system of the color image forming apparatus (1).
Figure 5:
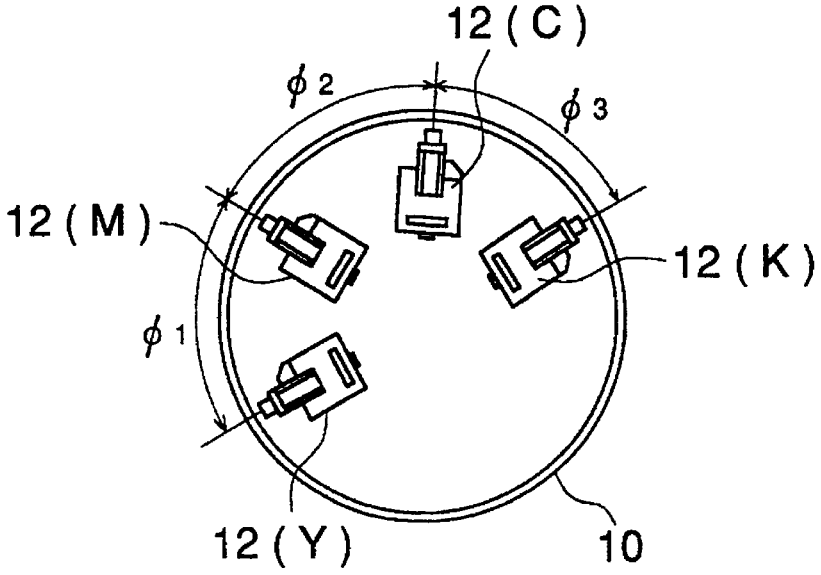
FIG. 5 is a view of the arrangement of an exposure optical system of the color image forming apparatus (2).

As shown in FIG. 4 or FIG. 5, when angles of the rotation center of the photoreceptor drum 10 with respect to each exposure optical system are $\theta_1$, $\theta_2$, $\theta_3$ (FIG. 4) or $\phi_1$, $\phi_2$, $\phi_3$ (FIG. 5), the exposure optical systems 12(Y), 12(M), 12(C) and 12(K) are arranged in positions on the periphery of the photoreceptor drum 10 so that $\theta_1$, $\theta_2$, $\theta_3$ (or $\phi_1$, $\phi_2$, $\phi_3$) have a relationship of a ratio of integer.

An example of the ratio of integer is as follows: $\theta_1$: $\theta_2$: $\theta_3$ =1: 2: 1, or 3: 4: 3, or $\phi_1$: $\phi_2$: $\phi_3$=1: 2: 1, or 3: 4: 3. As described in the above example, at least two angles may be equal, (arranged at equal intervals). For example, when $\theta_1$ is specified to 45°, 60°, or 67.5°, the following ratios of angles may be used: $\theta_1$: $\theta_2$: $\theta_3$=45°: 90°: 45°, or 67.5°: 90°: 67.5°.

FIGS. 4, 5, 6, 7 (A) and (7) B and 8 (A) and 8(B) show examples in which angles of the exposure optical systems 12(Y), 12(M), 12(C) and 12(K) with respect to the rotation center of the photoreceptor drum 10 are equal, (that is, for example, $\theta_1=\theta_2=\theta_3=60°$, or $\theta_1=\theta_2=\theta_3=60°$), and the exposure optical systems 12 (Y) , 12 (M) , 12 (C) , and 12 (K) are arranged around the periphery of the drum at equal intervals.

EXAMPLE 1

Figure 6:
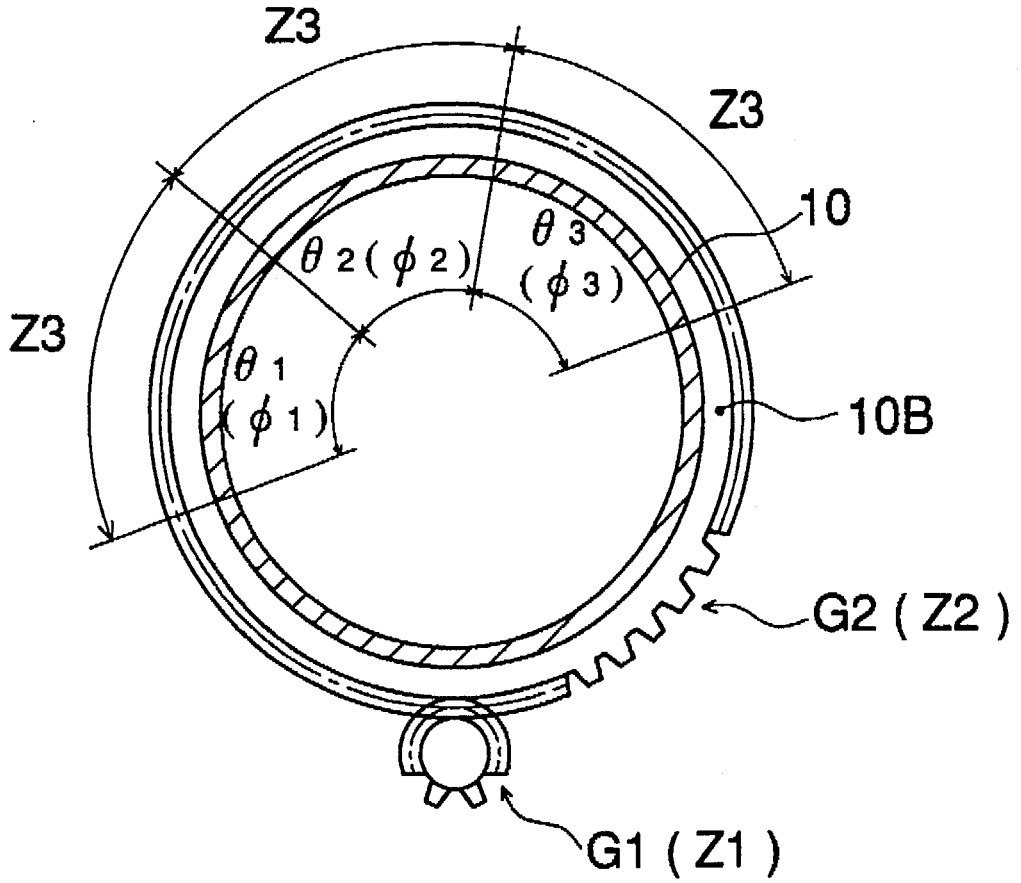
FIG. 6 is a illustration showing the composition of the number of teeth of a drive gear of a photoreceptor drum.
Figure 7:
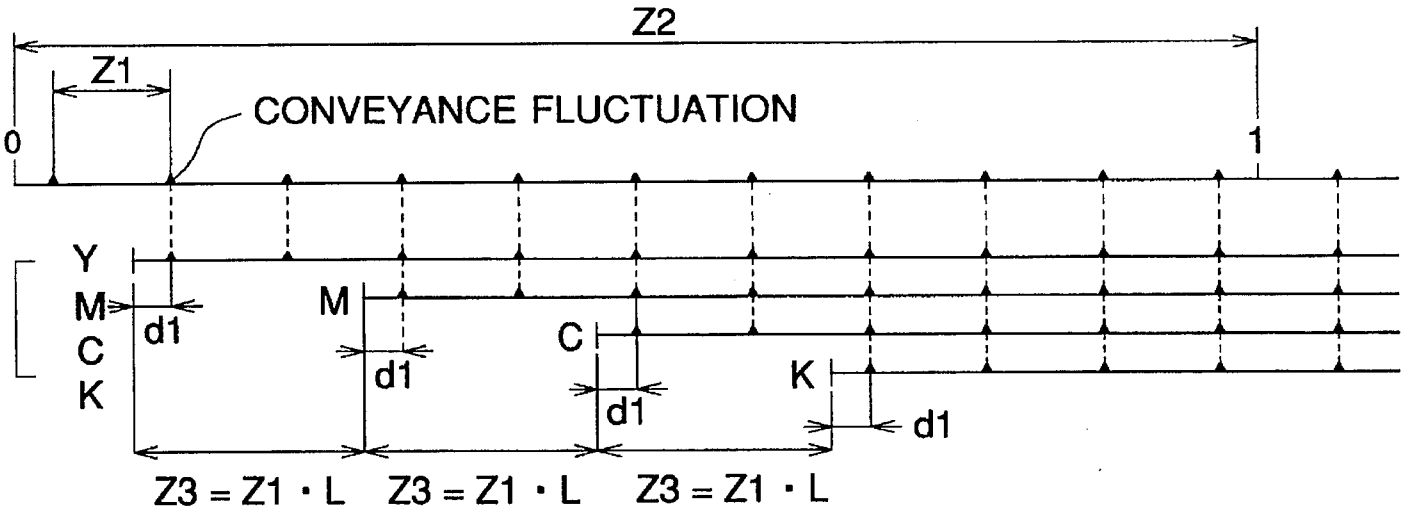
FIGS. 7(A) and 7(B) are views is a view showing the positions of occurrence of conveyance fluctuations of the image in the first embodiment, which is shown by the relationship of rotational periods of the photoreceptor drum in FIG. 7(A) and image-wise exposure periods in FIG. 7(B).

Referring to FIGS. 6 and 7(A) and 7(B), an example, corresponding to the first embodiment of the present invention, when the distance among the exposure optical systems, arranged around the periphery of the drum, is equal,(for example, $\theta_1=\theta_2\theta_3=60°$, or $\theta_1=\theta_2=\theta_3=60°$), will be described below.

When the number of teeth of the drive gear G1 is Z1, the number of teeth of the large gear G2 is Z2, and the number of teeth of the large gear G2 corresponding to the central angle $\theta_1$, $\theta_2$, $\theta_3$ or the central angle $\theta_1$, $\theta_2$, $\theta_3$ of the exposure optical system with respect to the drum is Z3, then, the composition of the number of teeth of each gear, or the value of the central angle $\theta_1$, $\theta_2$, $\theta_3$ or the central angle $\theta_1$, $\theta_2$, $\theta_3$ of the exposure optical system with respect to the drum is determined so that the number of teeth Z3 is equal to the number of teeth Z1 of the drive gear G1, or is an integer multiple of Z1.

Accordingly, even when uneven pitches or any eccentricity exist in a portion of teeth of the drive gear G1, and thereby causing conveyance fluctuation in the rotational direction of the photoreceptor drum 10 at the time of the image-wise exposure, that is, in the subsidiary scanning direction in the image scanning, and therefore, periodical image distortion or uneven pitch on the scanning lines is caused in each formed latent image, since these distortion or uneven pitch occurs in the same position on each latent image surface, each latent image is accurately superimposed.

As a result, each developed color toner image can be accurately superimposed in the same manner as in a normal portion even in a portion of image distortion or uneven pitch on the scanning lines. Accordingly, a high quality color image having no doubling and no uneven color can be provided.

In FIGS. 7(A) and 7(B), when the number of teeth Z3 is equal to the number of teeth of Z1, or an integer multiple (L times) of Z1, and thereby the position d1 at which conveyance fluctuation occurs in each image-wise exposure period is the same position, any of Y, M, C and k toner images formed by each image-wise exposure is accurately superimposed on other images in order to eliminate image distortion or uneven pitch on the scanning lines.

EXAMPLE 2

Figure 8:
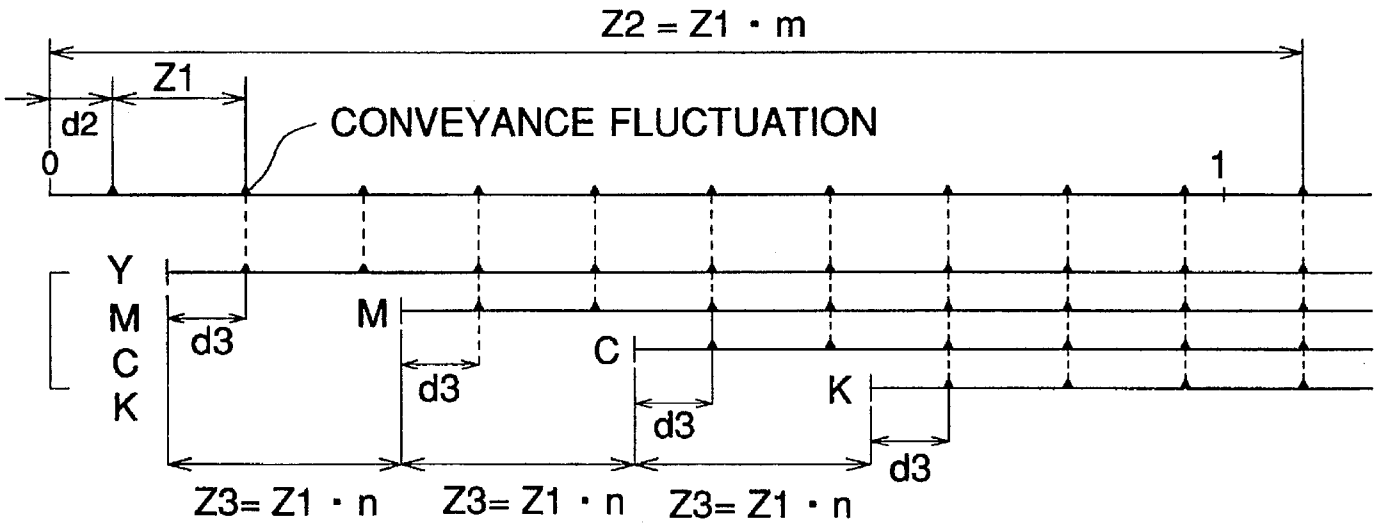
FIGS. 8 (A) and 8(B) are views is a view showing the positions of occurrence of conveyance fluctuations of the image in the second embodiment, which is shown by the relationship of rotational periods of the photoreceptor drum in FIG. 8(A) and image-wise exposure periods in FIG. 8(B).

Referring to FIGS. 6 and FIGS. 8(A) and 8(B), an example, corresponding to the second embodiment of the present invention, when the distance among the exposure optical systems, arranged around the periphery of the drum, is equal,(for example, $\theta_1=\theta_2=\theta_3 60°$, or $\theta_1=\theta_2\theta_3 60°$), will be described below.

When the number of teeth of the drive gear G1 is Z1, the number of teeth of the large gear G2 is Z2, and the number of teeth of the large gear G2 corresponding to the central angle $\theta_1$, $\theta_2$, $\theta_3$ or the central angle $\theta_1$, $\theta_2$, $\theta_3$ of the exposure optical systems with respect to the photoreceptor drum is Z3, the composition of the teeth of each gear, or the central angle $\theta_1$, $\theta_2$, $\theta_3$ or the central angle $\theta_1$, $\theta_2$, $\theta_3$ of the exposure optical systems with respect to the drum are determined so that the number of teeth Z2 of the large gear G2 is an integer multiple of the number of teeth Z1 of the drive gear G1, and the number of teeth Z3 is equal to or an integer multiple (n times) of the number of teeth Z1 of the drive gear G1. Due to such settings, the teeth of the large gear is always engaged with the teeth of the drive gear in the same engagement relationship.

Accordingly, even when uneven pitch or eccentricity exists in a portion of the teeth of the G1, and thereby conveyance fluctuation occurs during the rotation of the photoreceptor drum 10, the occurrence position is specified to positions having the same phase of the rotational period of the photoreceptor drum, because the number of teeth Z2 is an integer multiple of the number of teeth of Z1.

In the same manner, the occurrence position of the conveyance fluctuation is specified to the positions having the same phase on the Y, M, C and K toner images, because the number of teeth Z3 is an integer multiple of the number of teeth Z1.

As a result, even in a portion of image distortion or uneven pitch on the scanning lines, the portion is regulated to a specified position on the image surface, and each developed color toner image can be accurately superimposed in the same manner as in a normal portion. Accordingly, a high quality color image having no doubling and no uneven color can be provided. FIGS. 8(A) and 8(B) show an example in which an initial position d2 of the occurrence of conveyance fluctuation with respect to the rotational period of the photoreceptor drum 10 is specified when the number of teeth Z2 is an integer multiple (m times) of the number of teeth Z1; the position d3 of the occurrence of the conveyance fluctuation with respect to each image exposure period is specified to be the same position when the number of teeth Z3 is an integer multiple (n times) of the number of teeth Z1; and image distortion or deformation of the color image, formed by this image forming apparatus, can be recorded in specified common positions on the image.

Further, in examples 1 and 2, it is preferable that the number of teeth of Z2 is an integer multiple of the number of teeth of Z3.

In examples 1 and 2, when the drive gear G1 is rotated by a drive motor through a reduction gear, it is preferable that a combination of the reduction gear and a gear, the number of teeth of which is a ratio of integer of the number of teeth of the reduction gear, is adopted, in order to prevent uneven pitch over a long period or eccentricity.

Due to the present invention, the period of occurrence of speed fluctuation of the image forming body due to uneven pitch or eccentricity of the drive gear, can be specified. As a result, the image distortion or uneven pitch on the scanning line is regulated to occur at a specified common position on the image, and a color image forming apparatus is provided, in which the high quality image can be formed due to assurance of registration accuracy of the superimposed image.

What is claimed is:

1. A color image forming apparatus comprising:

(a) an image forming body for forming an image thereon, the image forming body including a follower gear;

(b) a drive gear provided on a main body of the apparatus for engaging with the follower gear to drive the image forming body to rotate;

(c) a plurality of charging devices each provided at a periphery of the image forming body for charging the image forming body;

(d) a plurality of imagewise exposure devices each for imagewise exposing the charged image forming body to form a latent image in the form of a line from an inside of the image forming body; and (e) a plurality of developing devices each provided at the periphery of the image forming body for developing the latent images to form toner images, wherein during one rotation of the image forming body a sequence of charging, imagewise exposing and developing is repeated to superimpose the toner images, with the toner images then being transferred onto a recording medium at one time, wherein each of the plurality of imagewise exposure devices is mounted on a part on a side opposite to the image forming body of a supporting member provided inside the image forming body and concentrically arranged with the image forming body, and is provided on a line radially drawn from a center of the image forming body, and wherein a number of teeth, which corresponds to an interval of the plurality of imagewise exposure devices, of the follower gear is the same as a number of teeth of the drive gear, or is an integer multiple of the number of teeth of the drive gear.

2. The color image forming apparatus of claim 1, wherein at least two of the plurality of imagewise exposure devices are equally spaced with respect to the image forming body.

3. The color image forming apparatus of claim 1, wherein a total number of teeth of the follower gear is an integer multiple of the number of teeth of the drive gear.

4. A color image forming apparatus comprising:

(a) an image forming body for forming an image thereon, the image forming body including a follower gear;

(b) a drive gear provided on a main body of the apparatus for engaging with the follower gear to drive the image forming body to rotate;

(c) a plurality of charging devices each provided at a periphery of the image forming body for charging the image forming body;

(d) a plurality of imagewise exposure devices each for imagewise exposing the charged image forming body to form a latent image in the form of a line from an outside of the image forming body; and (e) a plurality of developing devices each provided at the periphery of the image forming body for developing the latent images to form toner images, wherein during one rotation of the image forming body a sequence of charging, imagewise exposing and developing is repeated to superimpose the toner images, with the toner images then being transferred onto a recording medium at one time, wherein each of the plurality of imagewise exposure devices is mounted on a supporting member concentrically arranged with the image forming body, and is provided on a line radially drawn from a center of the image forming body, and wherein a number of teeth, which corresponds to an interval of the plurality of imagewise exposure devices, of the follower gear is the same as a number of teeth of the drive gear, or is an integer multiple of the number of teeth of the drive gear.

5. The color image forming apparatus of claim 4, wherein at least two of the plurality of imagewise exposure devices are equally spaced with respect to the image forming body.

6. The color image forming apparatus of claim 4, wherein all of the number of teeth of the follower gear is an integer multiple of the number of teeth of the drive gear.

* * * * *